US007832506B2

(12) United States Patent
Liang et al.

(10) Patent No.: US 7,832,506 B2
(45) Date of Patent: Nov. 16, 2010

(54) CUTTING ELEMENTS WITH INCREASED TOUGHNESS AND THERMAL FATIGUE RESISTANCE FOR DRILLING APPLICATIONS

(75) Inventors: Dah-Ben Liang, Woodlands, TX (US); Gary R. Portwood, Kingwood, TX (US); James C. Minikus, Spring, TX (US); Amardeep Singh, Houston, TX (US); Jonathan Bitler, Fayetteville, AR (US)

(73) Assignee: Smith International, Inc., Houston, TX (US)

( * ) Notice: Subject to any disclaimer, the term of this patent is extended or adjusted under 35 U.S.C. 154(b) by 241 days.

(21) Appl. No.: 12/059,775

(22) Filed: Mar. 31, 2008

(65) Prior Publication Data

US 2008/0245576 A1 Oct. 9, 2008

Related U.S. Application Data

(60) Provisional application No. 60/921,940, filed on Apr. 5, 2007, provisional application No. 60/944,706, filed on Jun. 18, 2007.

(51) Int. Cl.
*E21B 10/46* (2006.01)

(52) U.S. Cl. ..... 175/374; 175/425; 175/426

(58) Field of Classification Search ..... 175/425, 175/426, 374

See application file for complete search history.

(56) References Cited

U.S. PATENT DOCUMENTS 5,697,046 A 12/1997 Conley
6,197,084 B1 3/2001 Liang
6,655,478 B2 12/2003 Liang et al.
7,017,677 B2 3/2006 Keshavan et al.
7,036,614 B2 5/2006 Liang et al.
7,128,773 B2 10/2006 Liang et al.
2003/0226693 A1 * 12/2003 Liang et al. ..... 175/374
2004/0016557 A1 1/2004 Keshavan et al.
2004/0140133 A1 7/2004 Liang
2006/0254828 A1 11/2006 Liang et al.

FOREIGN PATENT DOCUMENTS

GB 2 391 236 2/2004
WO 03/049889 6/2003

OTHER PUBLICATIONS

Combined Search and Examination Report issued in GB application No. 0806198.8 dated Jun. 16, 2008 (6 pages).
Examination Report issued in GB application No. 0806198.8 dated Aug. 20, 2009 (1 page).
Combined Search and Examination Report for Application No. GB0921832.2, mailed on Jan. 13, 2010 (4 pages).

* cited by examiner

*Primary Examiner*—Giovanna C Wright
(74) *Attorney, Agent, or Firm*—Osha • Liang LLP

(57) ABSTRACT

Cutting elements offering increased toughness and thermal fatigue resistance can be formed of a wear resistant material having coarse grains disposed in a binder matrix with a binder content of at least about 18% by weight. The coarse grains include grains of at least one selected from the group of a transition metal carbide, a transition metal boride, and transition metal nitride. The binder content and coarse grain size may be selected to provide a Rockwell A hardness of at least about 75 Ra or a wear number of at least about 1.5.

37 Claims, 7 Drawing Sheets

1018 Microscrostructure

| Coarse Carbide Grade & Hardness Specification | | | |
|---|---|---|---|
| Co Binder Content (Weight %) | Nominal Hardness (Ra) ±0.4 | Relative Carbide Particle Size Number (micron) | Grade |
| 8 | 86.8 | 8 | 808 |
| 8 | 86.2 | 9 | 908 |
| 8 | 85.6 | 10 | 1008 |
| 10 | 86.2 | 8 | 810 |
| 10 | 85.6 | 9 | 910 |
| 10 | 85.0 | 10 | 1010 |
| 12 | 85.6 | 8 | 812 |
| 12 | 85.0 | 9 | 912 |
| 12 | 84.4 | 10 | 1012 |

*FIG. 7*

| 10-Series Coarse Carbide & Hardness Specification | | | |
|---|---|---|---|
| Relative Carbide Particle Size Number (micron) | Co Binder Content (Weight %) | Nominal Hardness (Ra) ±0.4 | Grade |
| 10 | 6 | 86.2 | 1006 |
| 10 | 8 | 85.6 | 1008 |
| 10 | 10 | 85.0 | 1010 |
| 10 | 12 | 84.4 | 1012 |
| 10 | 14 | 83.8 | 1014 |
| 10 | 16 | 83.2 | 1016 |
| 10 | 18 | 82.6 | 1018 |
| 10 | 20 | 82.0 | 1020 |

*FIG. 8*

CUTTING ELEMENTS WITH INCREASED TOUGHNESS AND THERMAL FATIGUE RESISTANCE FOR DRILLING APPLICATIONS

CROSS-REFERENCE TO RELATED APPLICATIONS

This application, pursuant to 35 U.S.C. §119(e), claims priority to U.S. Patent Application No. 60/921,940, filed on Apr. 5, 2007, and 60/944,706, filed on Jun. 18, 2007, both of which are herein incorporated by reference in their entirety.

BACKGROUND OF INVENTION

1. Field of the Invention

The present invention generally relates to cutting elements for downhole cutting tools. More specifically, the present invention relates to composite materials for cutting elements of downhole cutting tools, such as rock bits, which enhance the useful life of the cutting tools, and cutting tools incorporating the same.

2. Background Art

Conventional drilling systems used in the oil and gas and mining industries to drill wellbores through earth formations include a drilling rig used to turn a drill string which extends downward into a well bore. A drill bit is typically connected to the distal end of the drill string and is designed to break up earth formation in its path when rotated under an applied load. Typically, drilling fluid or air is pumped through the drill pipe and drill bit to move cuttings away from the bit during drilling and up an annulus formed between the drill string and the borehole wall.

Earth boring drill bits generally are made within one of two broad categories of bit structures. Drill bits in the first category are generally known as "fixed cutter" or "drag" bits, and usually include a bit body formed from steel or another high strength material and a plurality of cutting elements disposed at selected positions about the bit body. The cutting elements may be formed from any one or combination of hard or superhard materials, including, for example, tungsten carbide, natural or synthetic diamond, and boron nitride.

Drill bits of the second category are typically referred to as "roller cone" bits, and include a bit body formed from steel or another high strength material and having one or more roller cones rotatably mounted on the bit body. The roller cones are also typically formed from steel or other high strength material and include a plurality of cutting elements disposed at selected positions about the cones. The cutting elements may be formed from the same base material as the cone. These bits are typically referred to as "milled tooth" bits. Other roller cone bits include cutting elements, referred to as "inserts," which are press (interference) fit into holes formed and/or machined into the roller cones. The inserts may be formed from, for example, tungsten carbide, natural or synthetic diamond, boron nitride, or any one or combination of hard or superhard materials.

Due to its toughness and high wear resistance, cemented tungsten carbide is widely used to form cutting elements in rock-drilling and earth boring applications. "Cemented tungsten carbide" generally refers to a tungsten carbide composite which comprises tungsten carbide ("WC") grains bonded together by a binder phase. In most applications, the binder phase comprises cobalt (Co), nickel (Ni), and/or iron (Fe). Tungsten carbide grains dispersed in a cobalt binder matrix is the most common form of cemented tungsten carbide currently used for cutting elements in drilling applications, and is typically classified by grades based on the grain size of the tungsten carbide particles used and the cobalt content. However, in some cases, cemented tungsten carbide may be classified by grades based on the cobalt content and a material property such as hardness or wear resistance.

In general, cemented tungsten carbide grades are primarily made in consideration of two factors that influence the lifetime of a tungsten carbide insert: wear resistance and toughness. As a result, conventional tungsten carbide grades used for cutting elements of downhole drilling tools have cobalt contents of 6% to 16% by weight and tungsten carbide "relative" particle size numbers of 3 to 6 (which equates to an average tungsten carbide grain sizes of less than 3.0 microns (μm), as measured by the ASTM E-112 method). These conventional grades typically have a Rockwell A hardness of between 85 and 91 Ra, a fracture toughness below 17 ksi(in)$^{0.5}$ (as measured by the ASTM B-771 method) and a wear number between 1.8 to 5.0 (as measured by the ASTM B-611 method). In particular, these grades are widely used for inserts forming interior rows on roller cone bits.

Gage row inserts are often selected to have a higher wear number than interior row inserts because it is generally believed that gage inserts need higher wear resistance due to the large amount of borehole wall contact they encounter during drilling. As a result, the toughness of gage inserts is typically sacrificed to gain wear resistance. However, this practice improperly assumes that the rock to be drilled by the gage inserts generally has the same properties in every application. In many applications, this is not the case and this practice has led to the breakage of gage inserts with the interior rows still intact.

For example, when drilling softer formations, such as carbonates, the wear resistance of inserts is not the major concern because these formations are not very abrasive. Rather, resistance to thermal fatigue and heat checking has been found to be the primary concerns that result in premature cracking and breakage of inserts. This occurs because the tungsten carbide inserts of a rock bit are subjected to high wear loads from contact with a borehole wall, as well as high stresses due to bending and impact loads from contact with the borehole bottom. These high wear loads can lead to thermal fatigue of the inserts which, in turn, leads to the initiation of surface cracks (referred to as heat checking) on inserts. These surface cracks are then propagated by a mechanical fatigue mechanism caused by the cyclical bending stresses and/or impact loads applied to the inserts during drilling. The result is chipping, breakage, and/or failure of inserts which shortens the useful life of the drill bit.

In particular for roller cone drill bits, inserts that cut the corner of a borehole bottom are often subjected to the greatest amounts of thermal fatigue due to heat generation on the inserts from a heavy frictional loading component produced as the inserts engage the borehole wall and slide into their bottom-most crushing position. As the cone rotates, the inserts retract from the borehole wall and are quickly cooled by circulating drilling fluid. This repetitive heating and cooling cycle can lead to the initiation of surface cracks on the inserts (i.e., heat checking). These cracks are then propagated through the body of the insert as the insert repeatedly impacts the borehole wall and high stresses develop.

The time required to progress from heat checking to chipping, and eventually, to breakage of inserts depends upon several factors including the formation type, rotation speed of the bit, and applied weight on bit. In many applications, especially those involving higher rotational speeds and/or higher weights on bit, thermal fatigue and heat checking of inserts are issues that have not been adequately addressed.

Consequently, inserts made of standard tungsten carbide grades have been found to frequently fail in these applications.

To help reduce insert failures caused by thermal fatigue and heat checking, coarser grain carbide grades have been proposed for cutting elements of drill bits. Examples of grades proposed are further described in U.S. Pat. Nos. 6,197,084, 6,655,478, 7,017,677, 7,036,614, 7,128,773, and U.S. Publication No. 2004/0140133 A1, which are all assigned to the assignee of the present invention and incorporated herein by reference. These grades comprise coarse carbide grains having average grain sizes greater than 3.0 μm and binder contents of 6 to 16% by weight. Inserts formed from these composite materials have been found to exhibit higher fracture toughness and adequate wear resistance for many drilling applications. These inserts have been shown to result in improved performance and/or longevity when compared to inserts formed of conventional carbide grades. In particular, coarser grain composites have been found to be particularly useful in reducing gage carbide failures due to heat checking.

While improvements in bit life have been seen, premature breakage and failure of inserts has still been found to occur in some applications. Accordingly, a desire exists for improved composite materials that provide enhanced thermal fatigue and shock resistance with adequate wear resistance for these drilling applications to help further improve drill bit life.

SUMMARY OF INVENTION

In one aspect, the present invention provides a cutting element for a downhole cutting tool which includes a wear resistant material having increased toughness and thermal fatigue resistance. The wear resistant material includes coarse grains disposed in a binder matrix with a binder content of at least about 18% by weight. The coarse grains are grains of at least one selected from the group of a transition metal carbide, a transition metal boride, and transition metal nitride. In one or more embodiments, the grain size and binder content of the wear resistant material such that the wear resistant material has a Rockwell A hardness of greater than about 75 Ra or a wear number of at least about 1.5.

These and other aspects and advantages of the present invention will be apparent from the following description and the appended claims.

BRIEF DESCRIPTION OF DRAWINGS

FIG. 7 shows an example specification table listing cobalt binder content and nominal hardness for different coarse grade tungsten carbide grades.

FIG. 8 shows an example specification table listing cobalt binder content and nominal hardness for different 10-series coarse carbide grades.

DETAILED DESCRIPTION

Figure 1:
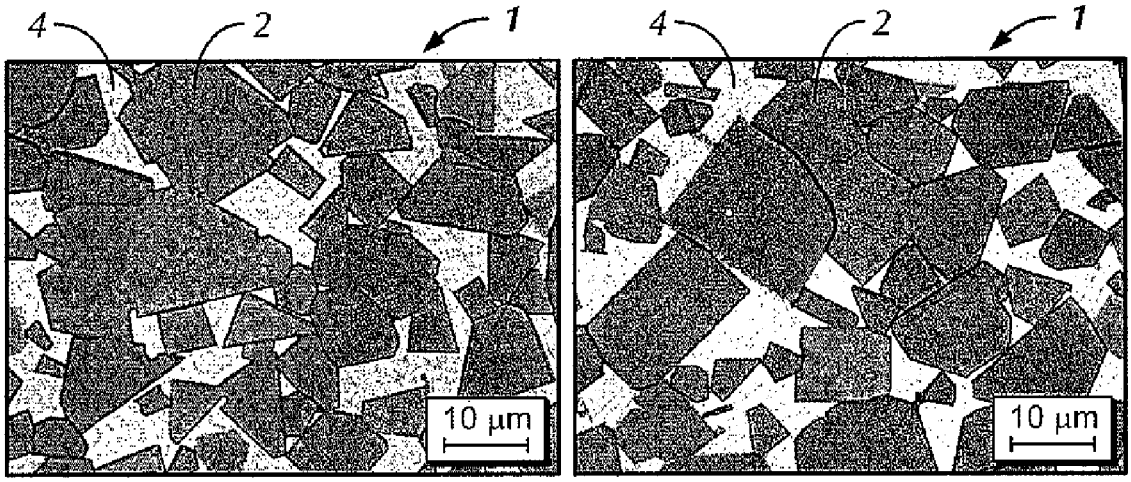
FIG. 1 shows a micrograph of a coarse grade tungsten carbide composite for a cutting element in accordance with one embodiment of the present invention.

Recent improvements in cutting element performance have been accomplished by using larger or coarse grain carbide grades to form cutting elements for drill bits used in selected applications, such as in drilling carbonate formations and the like. These coarse grades have average carbide grain sizes greater than 3 microns (μm) and binder contents of 6 to 16% by weight. The use of these grades has been found to reduce gage cutting element failures that occur due to thermal fatigue and heat checking. While improvements in cutting element life have been seen, additional improvement is desired to further extend the useful life of drill bits and other downhole cutting tools.

Accordingly, the present invention provides new composite materials for forming cutting elements of downhole cutting tools to provide increased fracture toughness and adequate wear resistance for drilling applications. Cutting elements formed from these materials are considered particularly useful in drilling certain types of formations, such as carbonate formations and the like, where thermal fatigue and heat checking failures frequently occur. Cutting elements formed in accordance with one or more embodiments of the present invention may provide increased toughness and an ability to resist chipping and breaking after thermal fatigue cracks have formed.

Because tungsten carbide grains bonded together in a cobalt binder matrix is considered representative of wear-resistant material for cutting elements of downhole cutting tools, embodiments of the present invention will be explained herein with reference to a tungsten carbide/cobalt (WC/Co) system. However, it should be appreciated that the invention is not limited to a WC/Co system. In other embodiments, other suitable materials may be used for the coarse grain hard phase particles, including transition metal borides, transition metal carbides, and transition metal nitrides. For example, carbides, borides, or nitrides formed from refractory metals including tungsten (W), titanium (Ti), molybdenum (Mo), niobium (Nb), vanadium (V), hafnium (Hf), tantalum (Ta), chromium (Cr), are specifically considered within the scope of the present invention. Similarly, in other embodiments other suitable binder materials may be used, including cobalt (Co), nickel (Ni), iron (Fe), and alloys thereof.

The following naming convention will be used herein to refer to example embodiments in accordance with the present invention. According to this convention, carbide grades are referred to by a three or four digit code name, wherein the first one or two digits (one if a three digit code, two if a four digit code) indicates the "relative" (or nominal) particle size of the carbide particles used and the last two digits indicate the cobalt content of the composition by weight. For example, Grade "510" represents a carbide grade having a carbide relative particle size number of 5 and a binder content of 10% by weight and Grade "1010" represents a carbide grade having a carbide relative particle size number of 10 and a binder content of 10% by weight. It should be noted that the "relative" particle size numbers used in this naming convention do not indicate the actual particle sizes of the carbide grains. For example, a Grade 510 composite will typically have an average carbide particle size of around 2.5 μm (as measured by the ASTM E-112 method) and a Grade 1010 composite will typically have an average carbide particle size of around 9 μm (as measured by the ASTM E-112 method). Additionally, composite materials having the same "relative" particle sizes, such as 10 , for example, will be collectively referred to as "10-series" carbide grades. This naming convention and examples of average grain sizes measured for different carbide grades are further described in the patents and published application incorporated herein by reference.

Now referring to aspects of the present invention, in one aspect the present invention provides a cutting element for a downhole cutting tool, wherein at least a portion of the cutting element is formed of a wear resistant material comprising coarse grains of a hard phase material (e.g., tungsten carbide (WC)) bonded together by a binder phase (e.g., cobalt (Co)). The binder content and coarse grain size are selected to provide increased fracture toughness and satisfactory wear resistance for a selected drilling application. In accordance with this aspect of the present invention, the increased fracture toughness is obtained by using a higher binder content to form the wear resistant material, such as a binder content of 18% or more by weight. In particular, the inventors have determined that by using a combination of a higher binder content and coarse grain hard phase particles (with average or median grain size greater than 3 μm), increased resistance to thermal fatigue and heat checking failures can be obtained as compared to conventional cutting elements used in similar applications.

In one or more embodiments, the binder composition and coarse grain size of the wear resistant material are selected such that the wear resistant material has at least one property selected from the group of: (1) a Rockwell A hardness of at least about 75 Ra; (2) a Palmqvist toughness of at least about 800 kg/mm; (3) a wear number of at least about 1.5 (as measured by the ASTM B-611 method); and (4) a fracture toughness greater than 20 ksi(in)$^{0.5}$ (as measured by the ASTM B771 method or a modified ASTM E399 method). In one or more embodiments, the binder composition and coarse grain size are selected such that the wear resistant material has a hardness within the range of 75 to 85 Ra and/or a wear number within the range of about 1.5 to 2.5. For example, in one embodiment, the wear resistant material may comprise a binder content within a range of 18% to 24% by weight, or more preferably 18% to 22% by weight. Additionally, the wear resistant material may comprise a median or average hard phase particle grain size of at least 5 μm, or more preferably, at least 7 μm (as determined by the ASTM E-112 method).

A wear resistant material in accordance with the above aspects of the present invention may be preferably formed using high purity coarse carbide grains, such as tungsten carbide (WC) grains having a maximum impurity content of 0.2% or less by weight, or more preferably 0.1% or less by weight. This may be done to provide enhanced thermal fatigue and shock resistance desired for a particular application. For example, in one embodiment the tungsten carbide particles used may comprise carburized tungsten carbide and the wear resistant material may be formed by consolidating the particles with a binder material through a liquid phase sintering process, or other sintering or binding process known in the art. In general, it should be appreciated that by using carbide grains of higher purity content, greater hardness values or wear resistance can also be achieved. However, in certain situations, select additives, or contaminants such as vanadium carbide (VC) and chromium carbide (Cr3C2) can increase hardness more than standard tungsten carbide.

Now referring to FIG. 1, a micrograph of a wear resistant material used to form at least a portion of a cutting element in accordance with an embodiment of the present invention is shown. The wear resistant material 1 comprises coarse grains of tungsten carbide particles 2 bonded together in a cobalt binder matrix 4. The wear resistant material 1 has a cobalt binder content of about 18% by weight and a tungsten carbide relative particle size of 10. Based on the binder content and relative particle size used, this material will be referred to as "Grade 1018".

Figure 2:
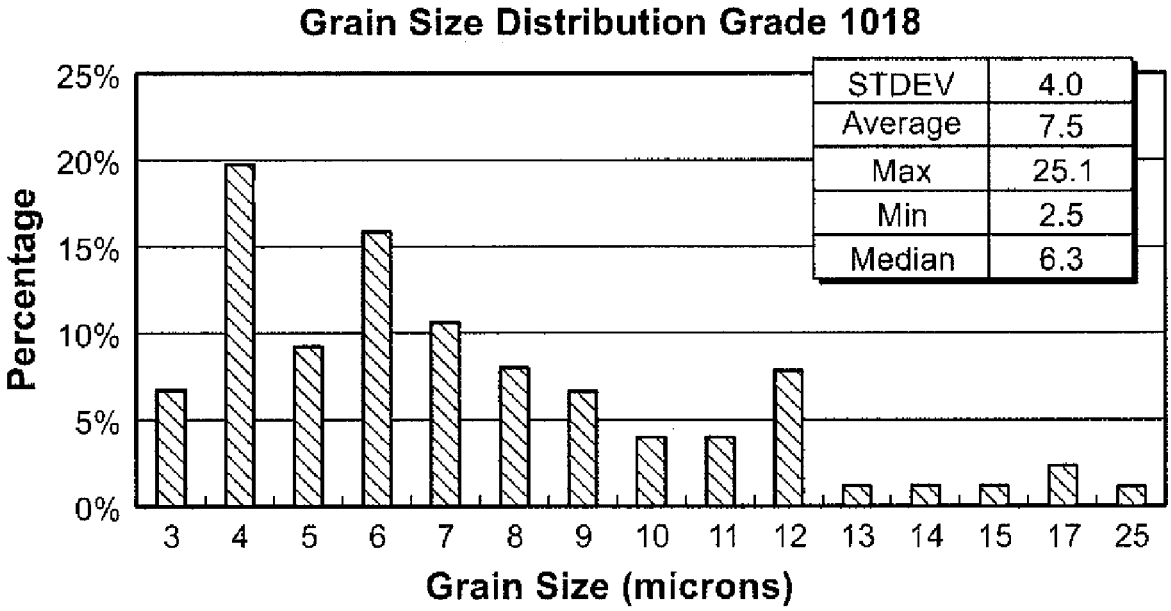
FIG. 2 shows an example grain size distribution for a 10-series composition.

The grain size distribution for the wear resistant material shown in FIG. 1 is shown in FIG. 2. This Grade 1018 composite was found to have an average tungsten carbide grain size of 7.5 μm and a median grain size of 6.3 μm (as measured by the ASTM E-112 method). The difference in the average grain sizes noted for 10-series composites having different binder contents may be due in part to a difference in WC contiguity. However, it is expected that 10-series composites formed with higher binder contents, such as contents of 18% or more by weight, will typically have average grain sizes ranging between 7 to 9 μm.

Figure 3:
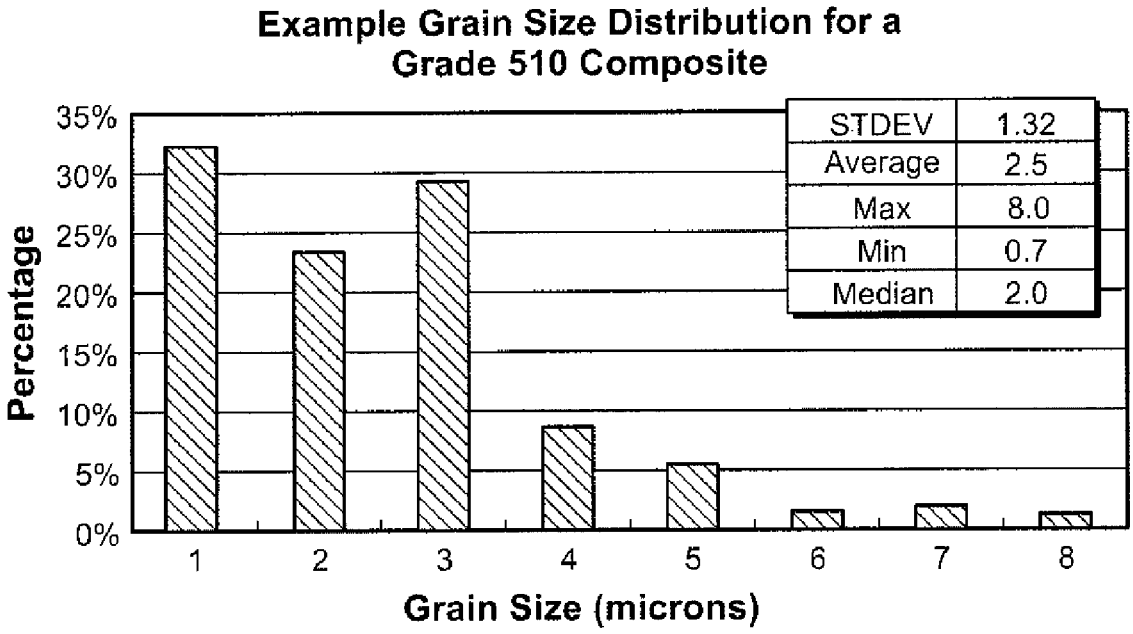
FIG. 3 shows an example grain size distribution for a conventional Grade 510 composition.
Figure 4:
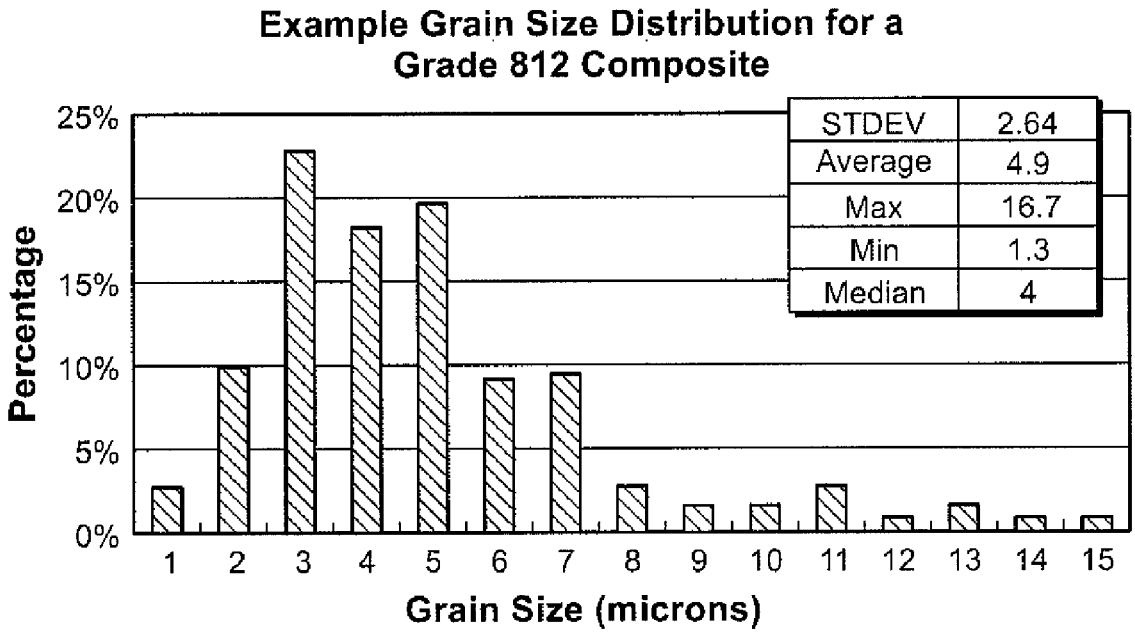
FIG. 4 shows an example grain size distribution for a Grade 812 composition.

Properties for Grade 1018 composites formed in accordance with embodiment of the present invention were measured and compared with carbide Grades 510, 812, and 1014 which are currently used for cutting elements in drilling applications. Grade 510 is a conventional carbide grade with a relative particle size number of 5 and cobalt content of 10% by weight. The grain size distribution for a Grade 510 composite is shown in FIG. 3. The composite had an average grain size of 2.5 μm and a median grain size of 2.0 μm. Grade 812 is a coarse carbide grade having a relative particle size of 8 and a cobalt binder content of 12% by weight. The grain size distribution for a Grade 812 composite is shown in FIG. 4. The composite had an average tungsten carbide grain size of 4.9 μm and a median grain size of 4.0. Grade 1014 is a recently proposed coarse carbide grade which has higher fracture toughness and thermal fatigue resistance. Grade 1014 has a relative particle size of 10 and a cobalt binder content of 14% by weight. Based on the grain size distributions for other 10-series composites, the Grade 1014 composite is considered to have an average or median tungsten carbide grain size between 7 and 9 μm.

Figure 5:
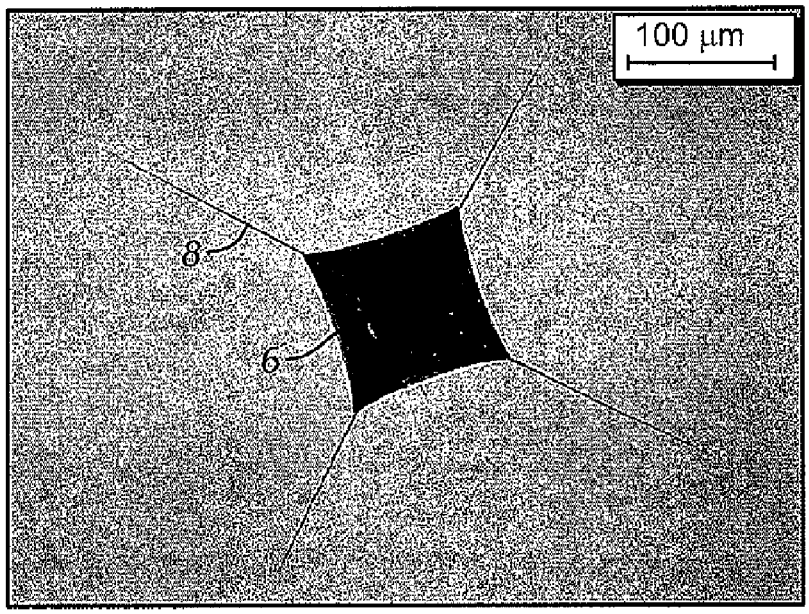
FIG. 5 shows a Vickers hardness indentation on a composite material and cracks extending from corners of the indentation made.

The Palmqvist toughness, in kg/mm, was determined for each of the carbide grades noted above, as shown in FIG. 6. Palmqvist toughness is a toughness value obtained from measuring crack lengths at the corners of a Vickers hardness indentation. For example, as shown in FIG. 5, a Vickers hardness indentation is first made in a composite material using an applied load P, such as a 150 kgf for tougher grades, and the lengths of the cracks which extend from each corner of the indentation are measured, wherein $l_1$, $l_2$, $l_3$, and $l_4$ represents the length of the crack at each corner, respectively. From these values a Palmqvist toughness value, W, can be calculated as $$W=P/(l_1+l_2+l_3+l_4).$$

Figure 6:
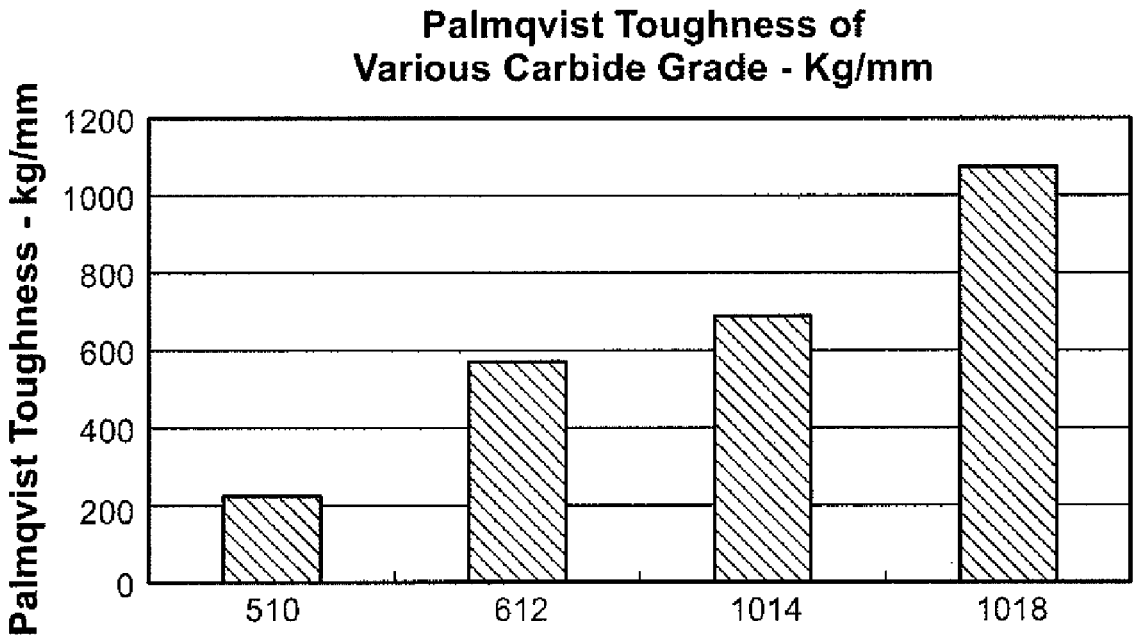
FIG. 6 shows the Palmqvist toughness of various carbide grades examined.

As shown in FIG. 6, only Grade 1018 formed in accordance with aspects of the present invention exhibited an average Palmqvist toughness greater than 800 kg/mm. More specifically, Grade 1018 had an average Palmqvist toughness value greater than 1000 kg/mm. This is compared to an average Palmqvist toughness value of around 200 kg/mm for Grade 510, an average Palmqvist toughness of around 600 kg/mm for Grade 812, and an average Palmqvist toughness of around 700 kg/mm for Grade 1014. Multiple tests were preformed on each carbide grade considered. The Palmqvist toughness values obtained from the tests performed and the calculated average Palmqvist toughness are listed below in Table 1. The average Palmqvist toughness for the two Grade 1018 composites considered was found to be 1078 kg/mm and 1035 kg/mm, respectively.

TABLE 1

| Carbide Insert Samples | | | | | |
|---|---|---|---|---|---|
| | Grade | | | | |
| Palmqvist (kg/mm) | 510 | 812 | 1014 | 1018 | 1018 |
| 1 | 273 | 642 | 559 | 832 | 934 |
| 2 | 235 | 495 | 737 | 1245 | 1519 |
| 3 | 167 | 586 | 788 | 1156 | 652 |
| Average | 225 | 574 | 695 | 1078 | 1035 |
| Hardness (Ra) | 87.66 | 85.53 | 83.75 | 82.47 | 82.45 |

The Rockwell A hardness of each of the carbide grades considered was also determined as shown in Table 1. Grade 510 had a hardness of 87.66 Ra, Grade 812 had a hardness of 85.53 Ra, and Grade 1014 had a hardness of 83.75 Ra. The Grade 1018 composites formed in accordance with embodiments of the present invention had Rockwell A hardness values of 82.47 Ra, and 82.45 Ra, respectively.

The K1c fracture toughness and wear resistance of Grades 510, 812, 1014, and 1018 were also determined as shown below in Table 2. Initially, the fracture toughness of Grades 510, 812, and 1014 was measured using the ASTM B-771 method. However, this method failed to produce valid data for the tougher material grades due to limitations in its toughness measurements beyond 25 ksi(in)$^{0.5}$. Therefore, the fracture toughness was redetermined using a modified ASTM E399 method (modified to include a Chevron notch similar to that used in the ASTM B-771 method and shown in U.S. application Ser. No. 11/343,225 titled "High Strength, High Toughness Matrix Bit Bodies" and assigned to the assignee of the present invention). This modified ASTM E399 method has been shown to yield K1c fracture toughness values comparable to those obtained from the B-771 method. As shown in Table 2, Grade 510 had a fracture toughness of around 13 ksi(in)$^{0.5}$, Grade 812 had a fracture toughness of around 18 or 19 ksi(in)$^{0.5}$, and Grade 1014 had a fracture toughness of around 23 to 25 ksi(in)$^{0.5}$ (as measured in accordance with the ASTM B-771 method or the modified ASTM E399 method). Grade 1018 formed in accordance with an embodiment of the present invention was determined to have a higher fracture toughness around 25 ksi(in)$^{0.5}$, and more particular a fracture toughness of 25.6 ksi(in)$^{0.5}$ (as measured in accordance with the modified ASTM E399 method). The wear number for Grades 510, 812, and 1014 were 3.7, 2.2, and 1.9, respectively (as measured in accordance with the ASTM B-611 method). Grade 1018 formed in accordance with an embodiment of the present invention was also found to have wear number of 1.9 (as measured in accordance with the ASTMTM B-611 method). Thus Grade 1018 was found to exhibit a combination of improved toughness and adequate wear resistance as compared to carbide grades previously used. Based on tests conducted it has been generally determined that significant improvement in toughness can be achieved while maintaining adequate wear resistance by forming cutting elements from a wear resistant material comprising coarser carbide grains and a higher binder content. Cutting elements formed using a Grade 1018 composition are expected to perform particularly well in the drilling of carbonate formations and the like due to their higher toughness and sufficient hardness which provides the highest resistance to thermal fatigue and heat checking failures for these applications.

TABLE 2

| Carbide Insert Samples | | | | |
|---|---|---|---|---|
| | Grade | | | |
| | 510 | 812 | 1014 | 1018 |
| Fracture Toughness (ksi · in$^{0.5}$) | | | | |
| B-771 | 13.53 | 18.14 | 25.00 | |
| Modified E-399 | 13.40 | 19.48 | 23.60 | 25.60 |
| Wear # (ASTM B611) | 3.7 | 2.0 | 1.9 | 1.9 |

In another embodiment, a cutting element is formed of a wear resistant material having a cobalt content of about 20% by weight and a tungsten carbide relative particle size number of 10. Based on the binder content and carbide grain size, this material will be referred to as "Grade 1020". The average grain size for the tungsten carbide used in Grade 1020 was around 7.5 μm. Due to its higher cobalt content and similar grain size as Grade 1018, Grade 1020 will yield an average Palmqvist toughness greater than 1000 kg/mm and a K1c fracture toughness greater than 25 ksi(in)$^{0.5}$. The hardness and wear resistance of Grade 1020 was also measured. Grade 1020 was determined to have a Rockwell A hardness of 82.30 Ra and a wear number of 1.7 (as measured in accordance with the ASTM B-611 method).

In the above examples, average and relative particle sizes are referenced in determining what "grade" to assign a given composition; however, in practice this may be difficult considered because of the number of particles within a given sample. Particles within a given sample tend to be non-uniform so values given above represent a "best estimate" approach to assigning the grade of carbide (i.e., assigning the first number in the three or four digit carbide code name).

An alternative method that may be used to identify carbide grades based on cobalt content and nominal hardness will now be described. As shown for example in FIG. 7, as the carbide grain size increases, the "nominal hardness" of a composite decreases. The hardness of a composite can be relatively easily tested by a variety of known methods. As shown in FIG. 7, carbide grades may be identified based on increments of 0.6 Ra. That is for a given amount of cobalt (e.g., 12%) as the relative particle size increases from say 8 to 10, the nominal hardness decreases from 85.6 (for "812") to 85.0 (for "912) to 84.4 (for "1012"). Further, referring to FIG. 8, in general as the amount of cobalt (a ductile material) increases by 2%, the nominal hardness of the material generally decreases by about 0.6 Ra. That is, for a given carbide series (e.g., 10) as the amount of cobalt increases from say 14% by weight to 18% by weight, the nominal hardness decreases from 83.8 (for "1014") to 83.2 (for "1016") to 82.6 (for "1018"). Thus, a specification such as the one shown in FIG. 7 or 8 may be easily developed and used to distinguish or assign carbide grades. For example, a carbide composite having a cobalt content of about 18% by weight and a Rockwell A hardness of about 82.6 Ra±0.4 Ra may be assigned a grade of 1018 based on cobalt content and hardness, without knowledge of the relative or average particle size used.

In accordance with aspects of the above alternative method for distinguishing carbides, a wear resistant material used to form a cutting element in accordance with one aspect of the present invention may simply be defined as comprising a binder or cobalt content of at least 18% by weight and a coarse carbide grain size, wherein the carbide grain size and binder content are selected such that the material has a hardness of at least about 75 Ra. In preferred embodiments, the wear resistant material may further comprise a wear number of at least about 1.5 (as measured in accordance with the ASTM B-611 method), a Palmqvist toughness of at least about 800 kg/mm (at least 900 kg/mm in an alternative embodiment), and/or a fracture toughness of at least about 20 ksi(in)$^{0.5}$ (as measured in accordance with the ASTM B-771 method or the modified ASTM E399 method). In one embodiment, the fracture toughness may be at least about 25 ksi(in)$^{0.5}$ or more.

Figure 9:
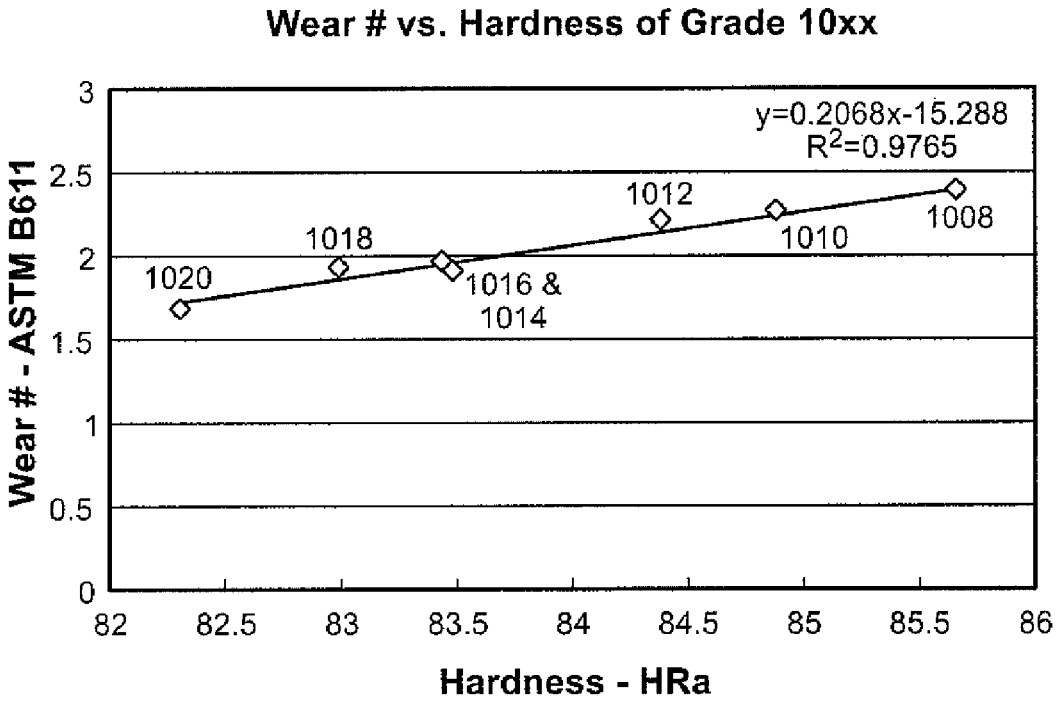
FIG. 9 shows a graphical representation of wear resistance vs. hardness for different 10-series coarse carbide grades including grades formed in accordance with an embodiment of the present invention.

FIG. 9 shows a graphical representation of wear resistance versus hardness for different 10-series carbide grades. Wear resistance and hardness are generally shown to decrease as the cobalt content (indicated by last two digits of each code name) increases. Grades 1018 and 1020, which were formed in accordance with embodiments of the present invention, both have Rockwell A hardness values greater than 75 Ra with wear number greater than 1.5 (measured in accordance with the ASTM B-611 method). More specifically, the hardness of Grade 1018 and Grade 1020 generally fell within the range of about 82 Ra to 83.5 Ra and their wear numbers generally fell within the range of about 1.5 to 2.0. In other embodiments, the wear resistant material may comprise any binder content greater than 18% by weight with coarse grade carbide grains, wherein the binder content and carbide grain size are selected such that the wear resistant material has a Rockwell A hardness greater than or equal to about 75 Ra with a wear number greater than or equal to about 1.5 (as measured in accordance with the ASTM B-611 method). In one or more embodiments, the binder content and coarse grain size may be selected to provide a wear resistant material having a Palmqvist toughness greater than or equal to 800 kg/mm and/or a fracture toughness of at least about 20 ksi(in)$^{0.5}$, or more preferably, greater than or equal to 25 ksi(in)$^{0.5}$.

Figure 10:
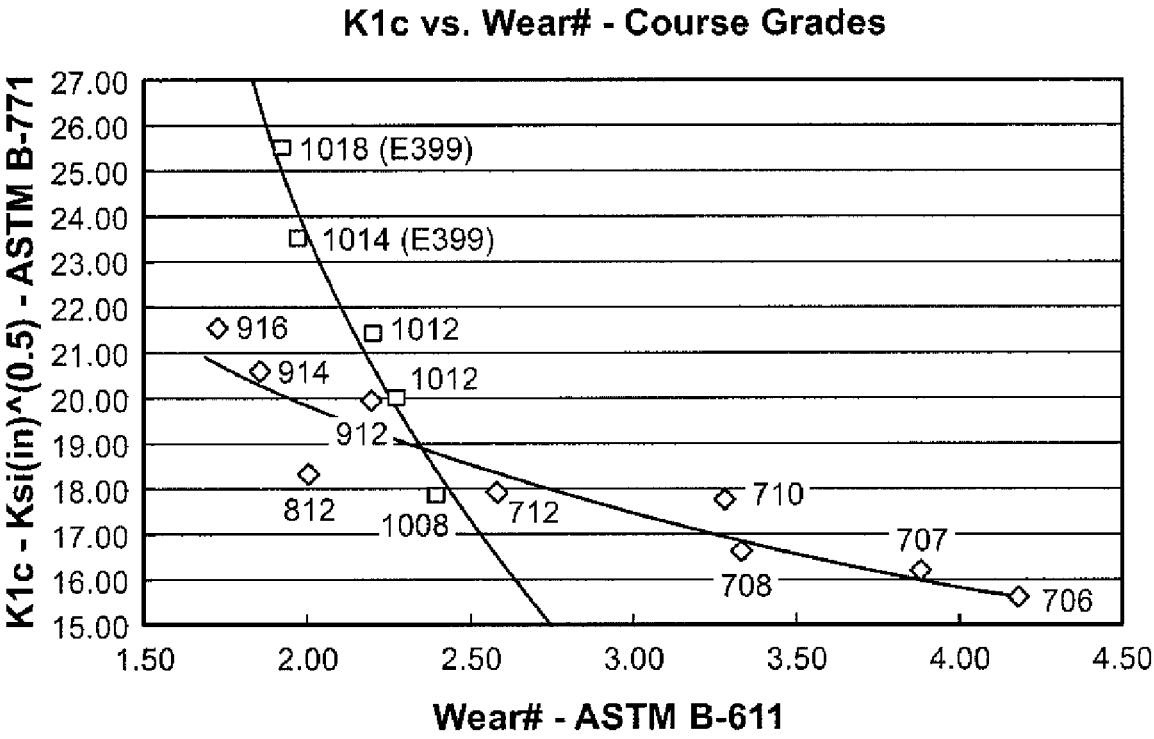
FIG. 10 shows a graphical representation of fracture toughness vs. wear resistance for different coarse carbide grades proposed or used to form cutting elements for downhole cutting tools, including a grade formed in accordance with an embodiment of the present invention.

FIG. 10 shows a graphical representation of fracture toughness vs. wear resistance for various carbide grades which may be used to form cutting elements of downhole cutting tools. As shown in FIG. 10, Grade 1018 formed in accordance with an embodiment of the present invention had a K1c fracture toughness greater than 20 ksi(in)$^{0.5}$ (as measured in accordance with the modified ASTM E399 method) with a wear number greater than 1.5 (as measured in accordance with the ASTM B-611 method). More specifically, Grade 1018 had a fracture toughness of about 25.6 and a wear number of 1.9. In other embodiments, the wear resistant material used to form at least a portion of a cutting element may comprise any binder content greater than or equal to 18% by weight and coarse grade carbide grains, wherein the binder content and carbide grain size are selected such that the wear resistant material has a fracture toughness greater than or equal to 20 ksi(in)$^{0.5}$ (as measured in accordance with the modified ASTM E399 method) and a wear number greater than or equal to about 1.5 (as measured in accordance with the ASTM B-611 method). In one or more embodiments, the wear resistant material may further comprise a Palmqvist toughness greater than or equal to 800 kg/mm, and/or a Rockwell A hardness greater than or equal to 75 Ra. In one embodiment, the wear resistant material may comprise a fracture toughness greater than 25 ksi(in)$^{0.5}$. Such features may be achieved in one embodiment by providing a wear resistant material having an average hard phase particle size greater than 3 μm and a binder content of 18% to 24% by weight.

Although example embodiments of wear resistance material in accordance with aspects of the present invention have been described with references to particle size and cobalt content, it will be appreciated that such ranges and values presented are merely example ranges and other values or ranges are acceptable so long as the physical properties of the material, such as, hardness, wear resistance, and toughness meet selected predetermined values, as described herein. Furthermore, suitable wear resistant material for constructing cutting elements according to one or more embodiments of the present invention may be defined as including wear resistant materials having one or more of the following properties: a Rockwell A hardness of at least about 75 Ra; a fracture toughness of at least about 20 ksi(in)$^{0.5}$ (as measured by the ASTM B-771 method or the modified ASTM E399 method); a wear number of at least about 1.5 (as measured by the ASTM B-611 method); and a Palmqvist toughness of at least about 800 kg/mm.

Carbide grades formed in accordance with embodiments of the present invention, may be used to provide cutting elements for downhole cutting tools which have increased toughness and an ability to resist breakage after thermal fatigue cracks have formed. Examples of downhole cutting tools include roller cone bits, percussion or hammer bits, drag or fixed cutter bits, milling tools, and other downhole cutting or machine tools. In one or more embodiments, the wear resistant material may form at least a portion of an insert used on a roller cone drill bit or other downhole drilling tool. Alternatively, in on or more other embodiments, the wear resistant material may be used to form a portion of a substrate for a shear cutter or diamond enhanced insert that includes a layer of ultrahard material bonded to a surface thereof. Carbide composites in accordance with above description can be used in a number of different applications, such as in tools for mining and construction applications where mechanical properties of higher fracture toughness, adequate wear resistance, and hardness are highly desired.

Figure 11:
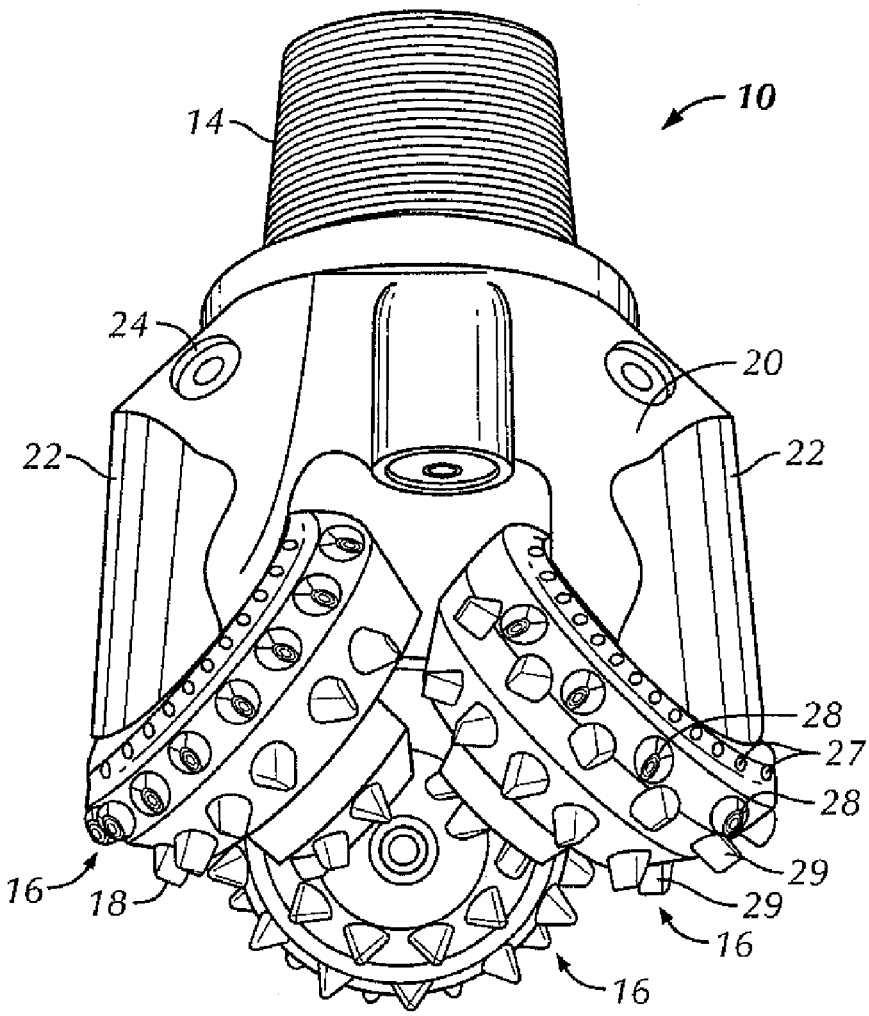
FIG. 11 shows a perspective view of a roller cone drill bit in accordance with an embodiment of the present invention.

FIG. 11 shows one example of a roller cone drill bit in accordance with an embodiment of the present invention. The drill bit 10 includes a bit body 20 having threads 14 formed at an upper end. The threads 14 are adapted to couple the bit 10 to a drill string assembly (not shown) for positioning the drill bit 10 in a wellbore. The bit body 20 also includes three legs 22 which extend at a lower end of the bit body 20. Each leg has a cantilevered journal (not shown). A roller cone 16 is rotatably mounted on the journal of each of the legs 22 proximal the lower end of the bit body 20. A plurality of cutting elements 18 is disposed on each roller cone 16. The cutting elements 18 may be integrally formed with, press-fit (or interference fit), brazed, or otherwise affixed in holes (not shown) formed in the roller cones 16.

The cutting elements 18 may be generally arranged in concentric rows about the surface of the cones 16. In such case, the rows typically include a heel row made up of heel row inserts 27, a gage row made up of gage row inserts 28, and interior rows made up of interior row inserts 29. The heel row inserts 27 and the gage row inserts 28 usually act together to drill and maintain the gage diameter of the borehole being drilled. The interior row inserts 29 generally act to crush and break up earth formation at the bottom of the borehole drilled. The inserts may be substantially equally spaced or selectively spaced about the circumference of a row. The geometric shape of the inserts is not considered critical for the invention; however, in some embodiments the inserts may have a semi-round top, a conical top, a chisel-shaped top, or a generally flat or blunt crest geometric shape.

Figure 12:
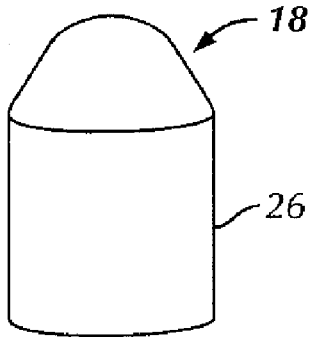
FIG. 12 shows an insert in accordance with an embodiment of the present invention.

In accordance with an embodiment of the present invention, at least one of the cutting elements 18 comprises an insert having a body formed of a wear resistant material as described herein. The insert may comprise a gage row insert, heel row insert, and/or an inner row insert on a cone of a roller cone drill bit. An enlarged view of cutting element 18 comprising an insert 26 in accordance with one or more embodiments of the present invention is shown for example in FIG. 12.

For example, in one embodiment at least one gage row insert 28 disposed on the roller cone drill bit 10 comprises a tungsten carbide insert, having a coarse grain size (i.e., an average grain size greater than 3 μm as determined by the ASTM E-112 method) and a binder content of at least about 18% by weight. The grain size and cobalt content may be selected to provide an insert having a Rockwell A hardness of at least about 75 Ra. The grain size and cobalt content may be further selected to provide at least one of a Palmqvist toughness of at least 800 kg/mm (or at least 900 kg/mm), a wear number of at least 1.5 (as measured by the ASTM B-611 method), and a fracture toughness of at least 20 ksi(in)$^{0.5}$ (as measured by the ASTM B-771 method or the modified ASTM E399 method). In one embodiment, the at least one gage row insert may be formed of a Grade 1018 composite having a binder content of 18% by weight and hard phase coarse grains having an average grain size greater than 7 μm. In another embodiment, the at least one gage row insert may be formed of a Grade 1020 composite having a binder content of about 20% by weight and hard phase coarse grains with an average grain size greater than 7 μm. In another embodiment, the at least one insert may be formed of wear resistant material having a binder content of 18% to 24% by weight and coarse hard phase grains having an average grain size greater than 5 μm.

Figure 13:
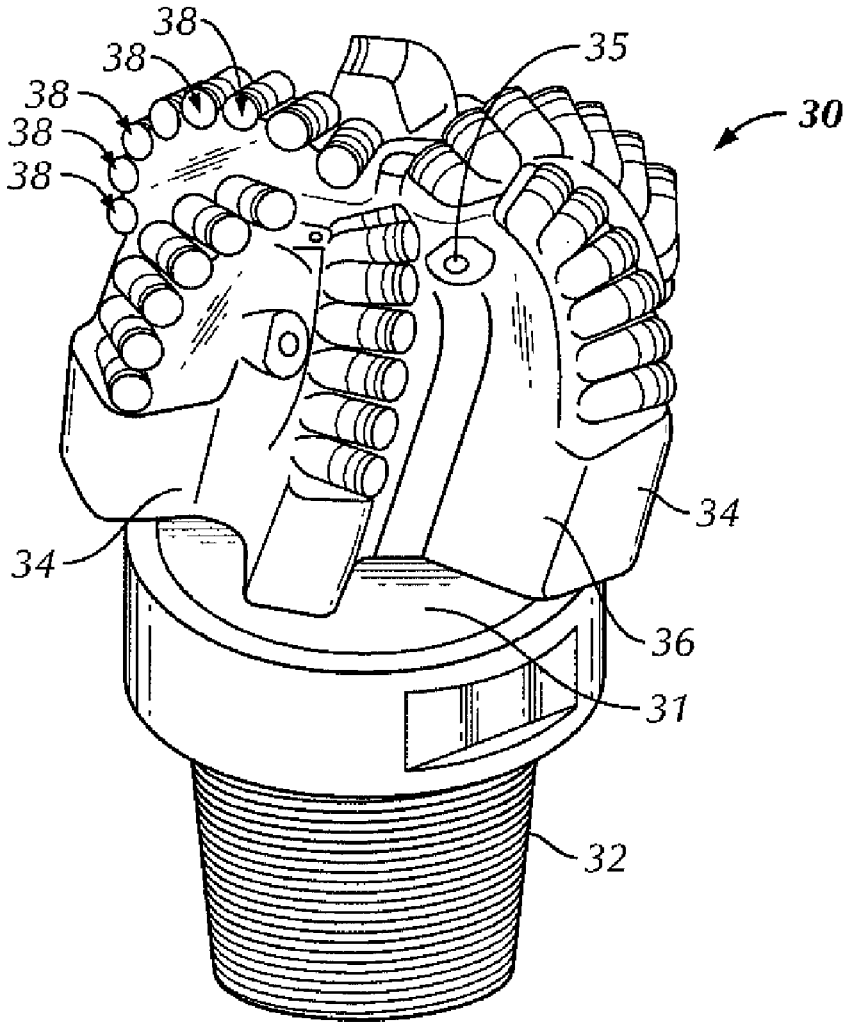
FIG. 13 shows a perspective view of a fixed cutter drill bit in accordance with an embodiment of the present invention.

FIG. 13 shows one example of a fixed cutter bit 30 for drilling subterranean formations in accordance with another embodiment of the present invention. The drill bit 30 includes a bit body 31 having threads 32 formed at an upper end which are adapted to couple the bit 30 to a drill string assembly (not shown) for positioning the drill bit 30 in a wellbore. The bit body 31 also includes a plurality of radially extending blades 34 that extend from a head 36 of the drill bit 30. A plurality of cutting elements 38 is disposed on each of the blades 34. The cutting elements 38 are press-fit, brazed, or otherwise affixed in holes (not shown) formed in the blades 34. The cutting elements 38 in this example comprise shear cutters 39, which include a substrate formed of a wear resistant material, such as cemented tungsten carbide or the like, and a layer of polycrystalline diamond (PCD) or diamond-like material bonded to the substrate. In accordance with an aspect of the present invention, at least one of the cutting elements 38 comprises a shear cutter 39 having a substrate formed of a wear resistant material as described above.

Figure 14:
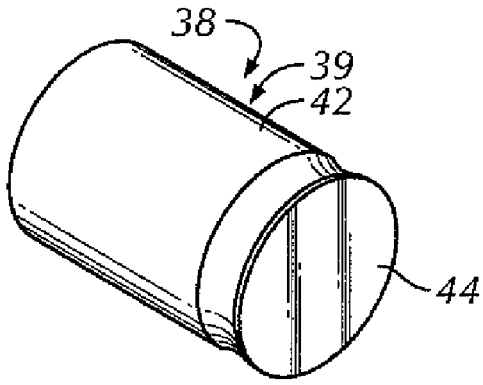
FIG. 14 shows a shear cutter in accordance with an embodiment of the present invention.

An enlarged view of a cutting element 38 comprising a shear cutter 39 is shown, for example, in FIG. 14. In one embodiment, the at least one shear cutter 39 on the drill bit 30 comprises a tungsten carbide substrate 42 having a coarse grain size (i.e., an average grain size greater than 3 μm as determined by the ASTM E-112 method) and a binder content of at least about 18% by weight. The grain size and cobalt content may be selected to provide a substrate 42 with a Rockwell A hardness of at least about 75 Ra. The grain size and cobalt content may be further selected to provide at least one of a Palmqvist toughness of at least 800 kg/mm (or at least 900 kg/mm), a wear number of at least 1.5 (as measured by the ASTM B-611 method), and a fracture toughness of at least 20 ksi(in)$^{0.5}$ (as measured by the ASTM B-771 method or the modified ASTM E399 method). A polycrystalline ultrahard material layer 44 is disposed over one end of the substrate. In another embodiment, the at least one shear cutter 39 may comprise a Grade 1018 composite having a binder content of 18% by weight and hard phase coarse grains having an average grain size greater than 7 μm. In another embodiment, the at least one shear cutter 39 may comprise a Grade 1020 composite having a binder content of about 20% by weight and hard phase coarse grains having an average grain size greater than 7 μm. In another embodiment, the at least one shear cutter 39 may be comprise a wear resistant material having a binder content of 18% to 24% by weight and coarse hard phase grains having an average grain size greater than 5 μm.

In general, control over particle size and cobalt content provides a measure of control over the toughness and wear resistance of a particular insert or substrate material. Thus, in one or more embodiments, drill bits and other downhole cutting tools may be designed so that cutting elements having desired properties are selectively positioned on the bit. For example, this may be beneficial in roller cone bit application where it is considered desirable to position inserts having different toughness and wear resistance properties on different rows of the bit. For example, in some embodiments, inserts positioned on interior rows may have a higher toughness and/or wear resistance than inserts positioned on gage rows. However, other cutting element arrangements are within the scope of the invention, and the particular embodiments described above are not intended to be limiting.

In general, a drill bit formed in accordance with one or more embodiments of the present invention may be threaded onto a lower end of a drill string assembly and lowered into a borehole. Once the bit is positioned at the bottom of the borehole, the drill string is rotated by, for example, a rig rotary table or a top drive under an applied weight on bit (WOB), and the cutting elements on the bit are forced to engage formation at the bottom and side of the borehole to scrape, crush and/or chip formation as the bit is rotated. Drilling fluid (often referred to as "drilling mud") may be pumped through the drill string and drill bit body and ejected from nozzles (12 in FIG. 11, 35 in FIG. 13) disposed in the bit body. Drilling fluid pumped through the bit may then be forced up the annulus between the drill string and the borehole wall to transport formation cuttings away from the bit and bottom of the borehole. The drilling fluid may also serve to cool and clean the cutting elements (18 in FIG. 11, 38 in FIG. 13) and bit as the borehole is drilled.

In another aspect, the invention provides a down hole cutting tool which comprises a plurality of cutting elements mounted on a cutting structure, wherein at least one of the cutting elements is formed from a wear resistant material having a binder of at least 18% by weight and a coarse grain size such that the portion of the cutting element formed of the wear resistant material has a Rockwell A hardness of at least 75 Ra and at least one selected from the group of: a Palmqvist toughness of at least about 800 kg/mm; a wear number of at least 1.5; and a fracture toughness of at least 20 ksi(in)$^{0.5}$. The cutting tool may comprise a drill bit, reamer, stabilizer, milling tool, hole opener, or similar tool. In one or more embodiments, the wear resistant material may comprise coarse grain tungsten carbide particles dispersed in a cobalt binder matrix. In particular embodiments, the tungsten carbide particles have an average grain size greater than 3 μm and a cobalt binder content in the range of 18% to 24% by weight. In one or more embodiments, the average grain size of the tungsten carbide particles may be greater than or equal to 7 μm or more. Further, in one or more embodiments, the cobalt content of the wear resistant material may fall within the range of 18% to 22% by weight. This may be done to provide a Palmqvist toughness greater than or equal to 1000 kg/mm and a wear number greater than 1.5. In one or more embodiments, the wear resistant material may also have a hardness in the range of about 75 to about 85 Rockwell A. Also, the wear resistant material may form the entire body of the cutting element, or only a select portion of the cutting element. Cutting elements formed of wear resistant material in accordance with one or more aspects of the present invention are expected to perform particularly well in drilling carbonate formations and the like due to their increased toughness, relative softness, and favorable thermal properties.

In another aspect, the present invention provides a method for improving the fracture toughness of composite materials used for cutting elements of downhole cutting tools by forming the composite material from coarse grain carbide particles (having an average grain size greater than 3 μm) and a higher binder content, such as a binder content of 18% or more by weight. Because of improved benefits provided by one or more embodiments of the present invention, cutting elements and bits made in accordance with the present invention may advantageously last longer, result in fewer trips required to change bits during drilling, and/or reduce the amount of rig down time, which may result in a significant cost saving during drilling. These and other advantages may be realized by selecting coarse carbide grain sizes and cobalt contents as described in one or more embodiments herein.

Although specific compositions have been disclosed as examples, those skilled in the art will appreciate that the present invention is not limited to the specific compositions described above. Rather the invention is expected to generally include any downhole cutting elements formed from any coarse grain composites having hard phase particles with average grain sizes greater than 3 μm and binder contents greater than 18% by weight which yield improved characteristics that fall within the scope of the invention as set forth in the claims. For example, it is considered expressly within the scope of the present invention that other embodiments may include inserts formed from wear resistant materials having relative particle sizes greater than 10 (i.e., an average particle size greater than 7 μm) or any combination of relative particle size and binder content selected to achieve at least one of a hardness greater than or equal to 75 Ra, an average Palmqvist toughness greater than 800 kg/mm, a wear number of at least 1.5, and a fracture toughness of at least about 20 ksi(in)$^{0.5}$. Further, from studies of the dependency of fracture toughness, elastic modulus, thermal conductivity, and coefficient of thermal expansion on various factors, such as grain size, cobalt content, and tungsten carbide purity, the inventors have discovered that thermal fatigue and shock resistance may be optimized for a given application by maintaining particular ranges for compositional characteristics and physical characteristics. Therefore in one or more selected embodiments, ranges for the compositional characteristics may include an average tungsten carbide grain size greater than 3 μm, a cobalt content greater than or equal to 18% by weight, and tungsten carbide impurity of less than 0.2% by weight, or more preferably less than 0.1% by weight. Similarly, in one or more embodiments, ranges for physical characteristics may include a hardness greater than 75 Ra, a fracture toughness of at least about 20 ksi(in)$^{0.5}$, or more preferably greater than or equal to 25 ksi(in)$^{0.5}$, a wear number of at least about 1.5, and Palmqvist toughness of at least about 800 kg/mm, or more preferably 1000 kg/mm.

In addition, it should be noted that coarse grain carbide materials described above may be obtained from companies such as Bruntal (a division of Osram in Towanda, Pa.) of the Czech Republic, Woka of Germany, and H.C. Starck of Germany. Moreover, while reference has been made to tungsten carbide and cobalt containing materials, wear resistant materials comprising other transition metal carbides, transition metal borides, or transition metal nitrides disposed in a metal binder matrix comprising cobalt, nickel, and/or iron are also considered within the scope of the present invention.

While the invention has been described with respect to a limited number of embodiments, those skilled in the art, having benefit of this disclosure, will appreciate that other embodiments can be devised which do not depart from the scope of the invention as disclosed herein. Accordingly, the scope of the invention should be limited only by the attached claims.

What is claimed is:

1. A cutting element, comprising:

wear resistant material, the wear resistant material comprising coarse grains having an average grain size of greater than 7 μm disposed in a binder matrix, the coarse grains comprising grains of at least one selected from the group of a transition metal carbide, a transition metal boride, and transition metal nitride, and the wear resistant material having a binder composition of greater than 18% by weight, wherein the binder composition and the coarse grain size are such that the wear resistant material has a hardness of at least about 75 Rockwell A, and wherein the binder composition and the coarse grain size are such that the wear resistant material has a Palmqvist toughness of at least 800 kg/mm.

2. The cutting element of claim 1, wherein the wear resistant material further comprises a wear number of at least about 1.5.

3. The cutting element of claim 2, wherein the wear number is within the range of 1.5 to 2.5.

4. The cutting element of claim 3, wherein the wear number is within the range of 1.5 to 2.0.

5. The cutting element of claim 1, wherein the Palmqvist toughness is at least 1000 kg/mm.

6. The cutting element of claim 1, wherein the hardness is in a range of about 75 to about 85 Rockwell A.

7. The cutting element of claim 1, wherein the wear resistant material has a fracture toughness of at least 20 ksi(in)$^{0.5}$.

8. The cutting element of claim 7, wherein the fracture toughness is at least 25 ksi(in)$^{0.5}$.

9. The cutting element of claim 1, wherein the coarse grains comprises grains of tungsten carbide and the binder material comprises cobalt.

10. The cutting element of claim 9, wherein the binder composition is greater than 18% up to 24% by weight cobalt.

11. The cutting element of claim 10, wherein the binder composition is greater than 18% up to 22% by weight cobalt.

12. The cutting element of claim 1, wherein the coarse grains have an average grain size within the range of greater than 7μm to 9 μm.

13. A down hole cutting tool comprising:

a plurality of cutting elements mounted on a cutting structure, wherein at least one of the plurality of cutting elements comprises a wear resistant material, the wear resistant material comprising coarse grains having an average grain size of greater than 7 μm disposed in a binder matrix, the coarse grains comprising grains of at least one selected from the group of a transition metal carbide, a transition metal boride, and transition metal nitride, and the wear resistant material comprising a binder composition of greater than 18% by weight wherein the binder composition and the coarse grain size are such that the wear resistant material has a hardness of at least about 75 Rockwell A and wherein the binder composition and the coarse grain size are such that the wear resistant material has a Palmqvist toughness of at least 800 kg/mm.

14. The cutting tool of claim 13, wherein the wear resistant material further comprises a wear number of at least about 1.5.

15. The cutting tool of claim 14, wherein the wear number is within the range of 1.5 to 2.5.

16. The cutting tool of claim 15, wherein the wear number is within the range of 1.5 to 2.0.

17. The cutting tool of claim 13, wherein the Palmqvist toughness is at least 1000 kg/mm.

18. The cutting tool of claim 13, wherein the hardness is in a range of about 75 to about 85 Rockwell A.

19. The cutting tool of claim 13, wherein the wear resistant material has a fracture toughness of at least 20 ksi$(in)^{0.5}$.

20. The cutting tool of claim 19, wherein the fracture toughness is at least 25 ksi$(in)^{0.5}$.

21. The cutting tool of claim 13, wherein the coarse grains comprises grains of tungsten carbide and the binder material comprises cobalt.

22. The cutting tool of claim 21, wherein the binder composition is greater than 18% up to 24% by weight cobalt.

23. The cutting tool of claim 22, wherein the binder composition is greater than 18% up to 22% by weight cobalt.

24. The cutting tool of claim 13, wherein the coarse grains have an average grain size within the range of greater than 7 μm to 9 μm.

25. The cutting tool of claim 13, wherein the cutting tool comprises a drill bit having a bit body, and the cutting structure comprises at least one roller cone rotatably coupled to the bit body, and the at least one of the plurality of cutting elements is disposed on the at least one roller cone.

26. The cutting tool of claim 25, wherein the at least one of the plurality of cutting elements is disposed on the gage row of the at least one roller cone.

27. The cutting tool of claim 13, wherein the cutting tool comprises a drill bit having a bit body, and the cutting structure comprises a plurality of radially extending blades disposed at one end of the bit body, and the at least one cutting element is disposed on at least one of the blades.

28. A down hole cutting tool comprising:

a plurality of cutting elements mounted on a cutting structure, wherein at least one of the plurality of cutting elements comprises a wear resistant material, the wear resistant material comprising coarse grains disposed in a binder matrix, the coarse grains comprising grains of at least one selected from the group of a transition metal carbide, a transition metal boride, and transition metal nitride, the grains having an average grain size of greater than 7 μm, and the wear resistant material having a binder content of greater than 18% by weight, and wherein the binder composition and the coarse grain size are such that the wear resistant material has a Palmqvist toughness of at least 800 kg/mm.

29. The down hole cutting tool of claim 28, wherein the wear resistant material further comprises a wear number of at least about 1.5.

30. The cutting element of claim 29, wherein the wear number is within the range of 1.5 to 2.5.

31. The cutting element of claim 28, wherein the Palmqvist toughness is at least 1000 kg/mm.

32. The cutting element of claim 28, wherein the wear resistant material has a fracture toughness of at least 20 ksi $(in)^{0.5}$.

33. The cutting element of claim 32, wherein the fracture toughness is at least 25 ksi$(in)^{0.5}$.

34. The cutting element of claim 28, wherein the coarse grains comprises grains of tungsten carbide and the binder material comprises cobalt.

35. The cutting element of claim 34, wherein the binder composition is greater than 18% up to 24% by weight cobalt.

36. The cutting element of claim 35, wherein the binder composition is greater than 18% up to 22% by weight cobalt.

37. The cutting element of claim 28, wherein the coarse grains have an average grain size within the range of greater than 7 μm to 9 μm.

* * * * *